US006379195B1

(12) United States Patent
Torikoshi et al.

(10) Patent No.: US 6,379,195 B1
(45) Date of Patent: Apr. 30, 2002

(54) ELECTRICAL JUNCTION BOX AND ITS ASSEMBLING METHOD

(75) Inventors: Makoto Torikoshi; Kazuhiko Yoshie, both of Hokkaido (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/598,944

(22) Filed: Jun. 22, 2000

(30) Foreign Application Priority Data

Jun. 24, 1999 (JP) ..... 11-178178

(51) Int. Cl.[7] ..... H01R 13/40
(52) U.S. Cl. ..... 439/733.1; 439/869; 439/949
(58) Field of Search ..... 439/76.2, 621, 439/949, 733.1, 869, 751

(56) References Cited

U.S. PATENT DOCUMENTS 5,088,940 A 2/1992 Saito ..... 439/621
5,116,230 A * 5/1992 Dechelette et al. ..... 439/101
5,252,094 A * 10/1993 Colleran et al. ..... 439/733.1
5,285,011 A * 2/1994 Shimochi ..... 174/52.1
5,383,800 A * 1/1995 Saka et al. ..... 439/787
5,421,735 A * 6/1995 Dechelette ..... 439/101
5,839,925 A * 11/1998 Simmons ..... 439/595
5,989,075 A * 11/1999 Hsiao et al. ..... 439/733.1

FOREIGN PATENT DOCUMENTS

GB 2 346 489 8/2000

* cited by examiner

*Primary Examiner*—Brian Sircus
*Assistant Examiner*—Hae Moon Hyeon
(74) *Attorney, Agent, or Firm*—Armstrong, Westerman & Hattori, LLP

(57) ABSTRACT

An electrical junction box consists of a relay terminal, a housing member having a receiving cavity formed therein for receiving the relay terminal, a circuit body having a mating terminal which mates with the relay terminal, and a locking means provided on the relay terminal for locking the relay terminal in the receiving cavity of the housing member. Lowering of positional accuracy of a relay terminal relative to a mating terminal and deformation of the relay terminal are prevented.

5 Claims, 8 Drawing Sheets

ELECTRICAL JUNCTION BOX AND ITS ASSEMBLING METHOD

BACKGROUND OF THE INVENTION

1. Field of the Invention

This invention relates to an electrical junction box.

2. Description of the Related Art

An electrical junction box as shown in FIG. 7 has conventionally been disclosed.

The electrical junction box 80 is made up of a circuit body 82 having a plurality of stacked busbar circuit boards 81, relay terminals 84 of a female-female type which are connected to tab-like terminals 83 disposed on the busbar circuit boards 81, a housing member 85 which receives the tab-like terminals 83 and the relay terminals 84, and an upper cover (not shown) for covering the housing member 85. The tab-like terminals 83 firmly stand upright, projecting from the circuit body 82.

As shown in FIGS. 7 and 8, the assembly of the electrical junction box 80 is completed by inserting the tab-like terminals 83 into the relay terminals 84 at one end to make an electrical connection therebetween, inserting the relay terminals 84, the other end first, into the receiving cavities 86 of the housing member 85, and fitting the upper cover to the housing member 85. Because the tab-like terminals 83 of the circuit body 82 are disposed in a row arrangement in the electrical junction box 80, the relay terminals 84 are also disposed likewise with the same pitch P as of the tab-like terminals 83.

With the above structure, however, the relay terminals 84 in connection with the tab-like terminals 83, being not locked relative to the latter, tend to tilt to the front and back or left and right relative to the circuit body 82 as shown in FIG. 9, resulting in the positional accuracy of relay terminals 84 lowered. Especially where the pitch P of the tab-like terminals 83 is small, neighboring relay terminals 84, 84 are caused to contact or interfere with each other. If the tilted relay terminal 84 is in error pushed into or against the housing member 85, it may get bent and deformed and at the worst broken.

SUMMARY OF THE INVENTION

This invention has been accomplished to overcome the above drawback and an object of this invention is to provide an electrical junction box which prevents lowering of positional accuracy of relay terminals relative to mating terminals, and which prevents deformation of relay terminals. A method of assembling an electrical junction box is also provided.

In order to attain the object, according to an aspect of this invention, there is provided an electrical junction box which comprises: a relay terminal; a housing member having a receiving cavity formed therein for receiving the relay terminal; a circuit body having a mating terminal which mates with the relay terminal; and a locking means provided on the relay terminal for locking the relay terminal in the receiving cavity of the housing member.

In the above electrical junction box, the relay terminal has the locking means which enables the relay terminal to be locked and stationary in the receiving cavity of the housing member. The relay terminal thus does not move out of place relative to the mating terminal.

Preferably, the locking means comprises a pair of locking bosses of round shape which project on both side walls of the relay terminal extending parallel to an insertion direction of the relay terminal into the receiving cavity.

Advantageously, the locking bosses are located at spaced positions in a longitudinal direction of the relay terminal.

In the above electrical junction box, the pair of locking bosses are located on both side walls of the relay terminal, at spaced positions in the longitudinal direction of the relay terminal. The relay terminal is thus locked in the receiving cavity by two locking bosses at two positions, enabling the relay terminal not to move out of place especially in the direction perpendicular to the relay terminal insertion direction.

Preferably, the locking means comprises a pair of locking bosses extending in a longitudinal direction on both side walls of the relay terminal while curved outwardly.

Preferably, the locking means comprises a pair of locking bosses extending in a longitudinal direction on both side walls of the relay terminal while projected outwardly in trapezoidal form.

According to another aspect of this invention, there is provided a method of assembling an electrical junction box having a relay terminal, a housing member with a receiving cavity formed therein for receiving the relay terminal, a circuit body having a mating terminal which mates with the relay terminal, and a locking means provided on the relay terminal for locking the relay terminal in the receiving cavity, which comprises: locking the relay terminal in the receiving cavity of the housing member by means of the locking means to prepare a sub connector; and assembling the sub connector to the circuit body to electrically connect the mating terminal of the circuit body to the relay terminal inside the sub connector.

In the above electrical junction box, because the relay terminal is locked in the receiving cavity of the housing member by means of the locking means, the relay terminal does not move out of place and is maintained in position in the receiving cavity. Further, because the sub connector is assembled to the circuit body to have the mating terminal of the circuit body inserted into the relay terminal inside the sub connector, an interference between the relay terminal and the housing member is prevented during assembling together the circuit body and the sub connector.

The above and other objects, features and advantages of this invention will become apparent from the following description and the appended claims, taken in conjunction with the accompanying drawings.

DESCRIPTION OF THE PREFERRED EMBODIMENT

An embodiment of this invention will now be described with reference to the attached drawings.

Figure 1:
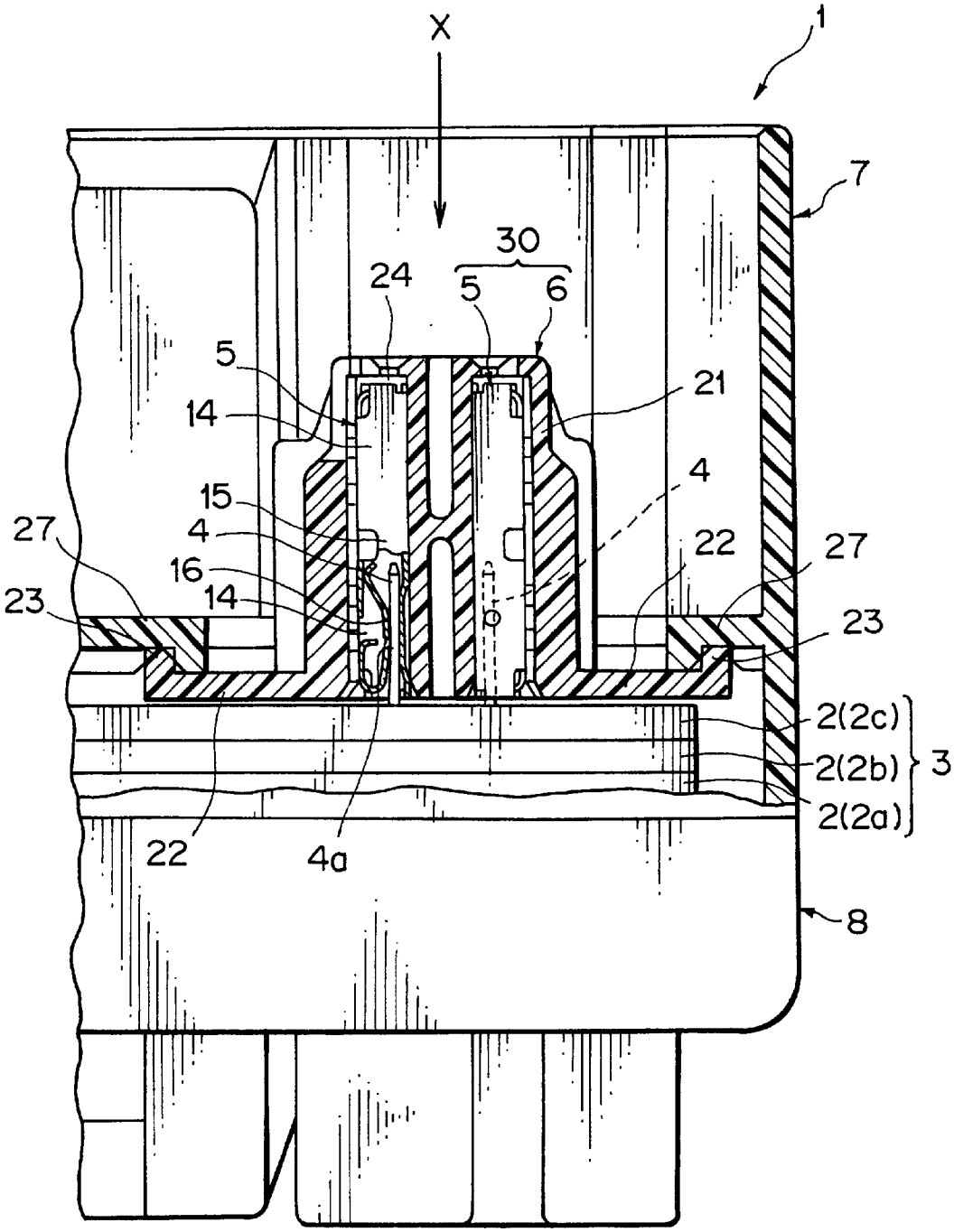
FIG. 1 is a partially sectional view of an electrical junction box according to one embodiment of this invention.

As shown in FIG. 1, an electrical junction box 1 is comprised of a circuit body 3 having a plurality of stacked busbar circuit boards 2, relay terminals 5 which are connected to tab-like terminals 4 upstanding from the circuit body 3, a housing member 6 which receives the tab-like terminals 4 and the relay terminals 5, an upper cover 7 which covers the housing member 6, and a lower cover 8 which receives the circuit body 3.

Figure 2:
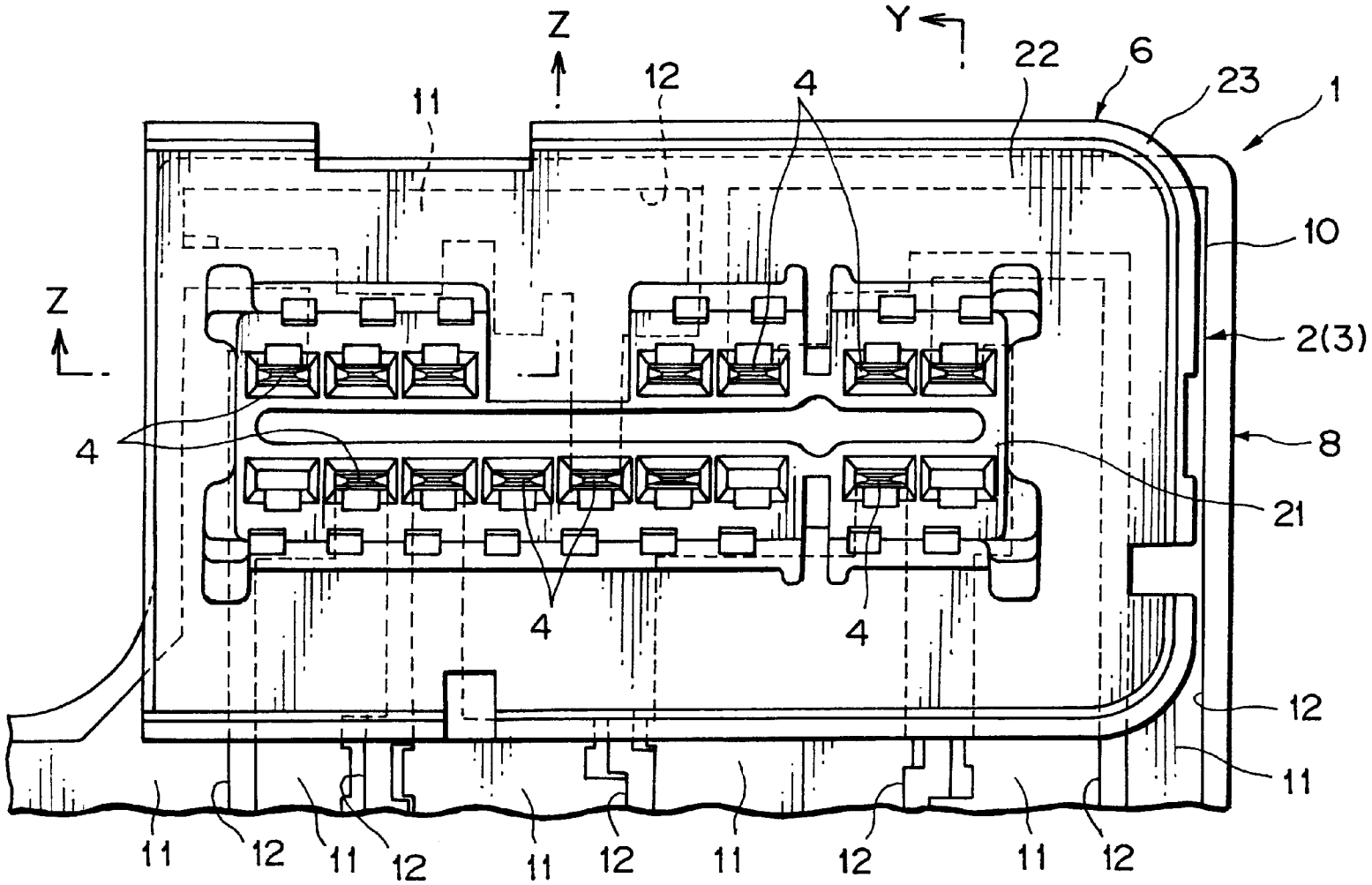
FIG. 2 is a view taken from the direction of an arrow X of FIG. 1.

As shown in FIGS. 1 and 2, the busbar circuit board 2 is comprised of a wiring board 10 of insulating resin and a plurality of busbars 11 disposed on the wiring board 10. The wiring board 10 is formed with placement grooves 12 of U-shaped cross section for placement therein of electrically conductive busbars 11, and terminal slots (not shown) for passing therethrough of the tab-like terminals 4 of the busbars 11. The busbars 11 form a desired circuit pattern on the wiring board 10, and the placement grooves 12 are of the same configuration as the circuit pattern of the busbars 11.

Figure 3:
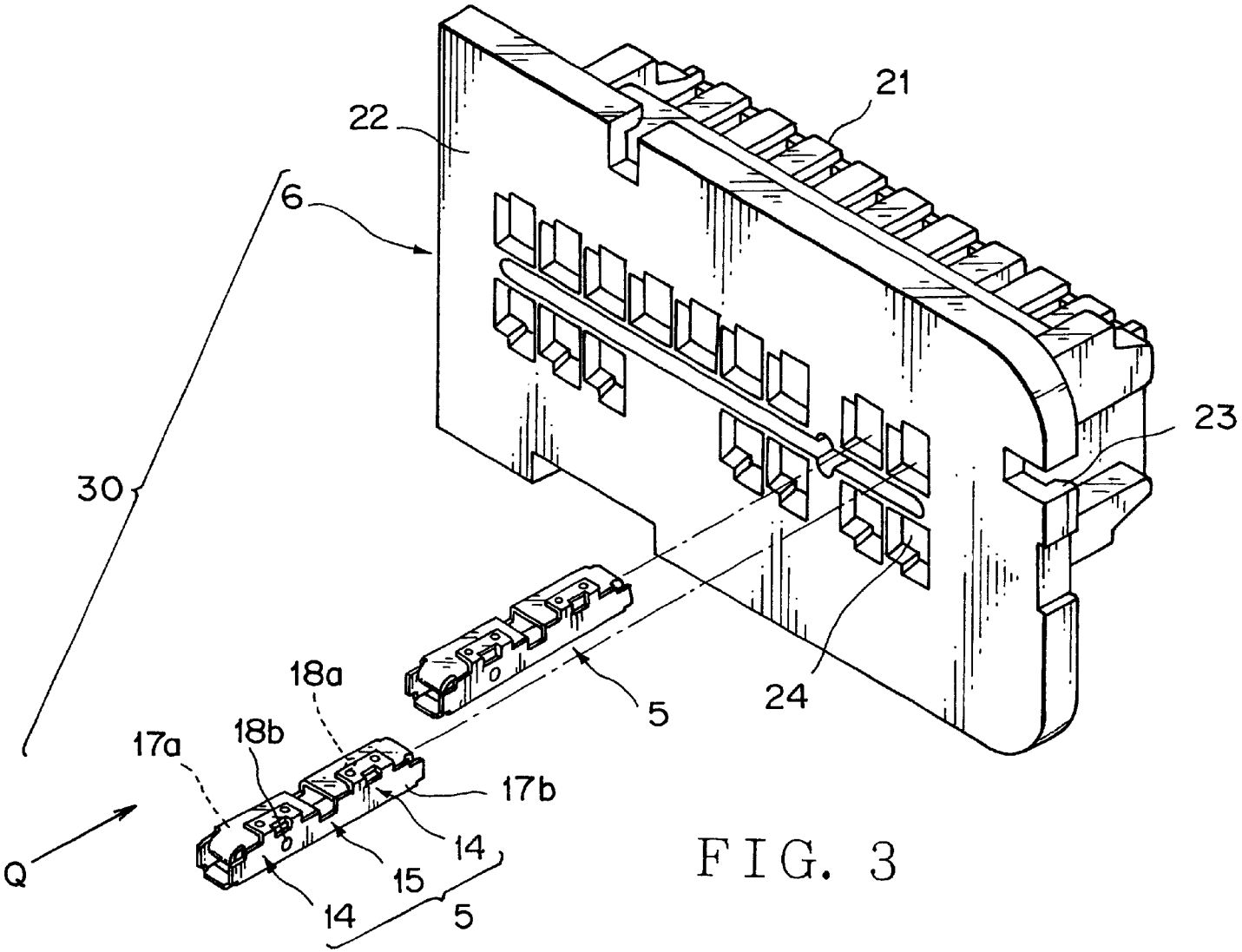
FIG. 3 is a perspective view showing relay terminals before inserted into a housing member of the junction box in FIG. 1.

As shown in FIGS. 1 and 2, the circuit body 3 is made up of the busbar circuit boards 2 stacked one upon another, and thus the tab-like terminals 4 of a lower busbar circuit board 2*a* project through the respective terminal slots of intermediate and upper busbar circuit board 2*b* and 2*c* to the outside. The tab-like terminals 4 of the circuit body 3 are arranged with a predetermined pitch (interval). As shown in FIGS. 1 and 3, the relay terminal 5 is of a female-female type and is made of an electrically conductive stamped metal plate. While in the present embodiment, the relay terminal 5 is shown to be of a female-female type, a female-male type, male-female type or male-male type relay terminal is also usable.

The relay terminal 5 is comprised of two electrical contact portions 14, 14 into which tab-like terminals 4 are insertable from opposite directions and a link portion 15 which integrally links the two electrical contact portions 14, 14. The relay terminal 5 is hollow, with the two electrical contact portions 14, 14 in communication with each other via the link portion 15.

As shown in FIG. 1, each electrical contact portion 14 has therein a resilient contact piece 16 for electrical contact with the related tab-like terminal 4, which comes into resilient contact with a contact surface 4*a* of the tab-like terminal 4 inserted into the electrical contact portion 14.

Figure 4:
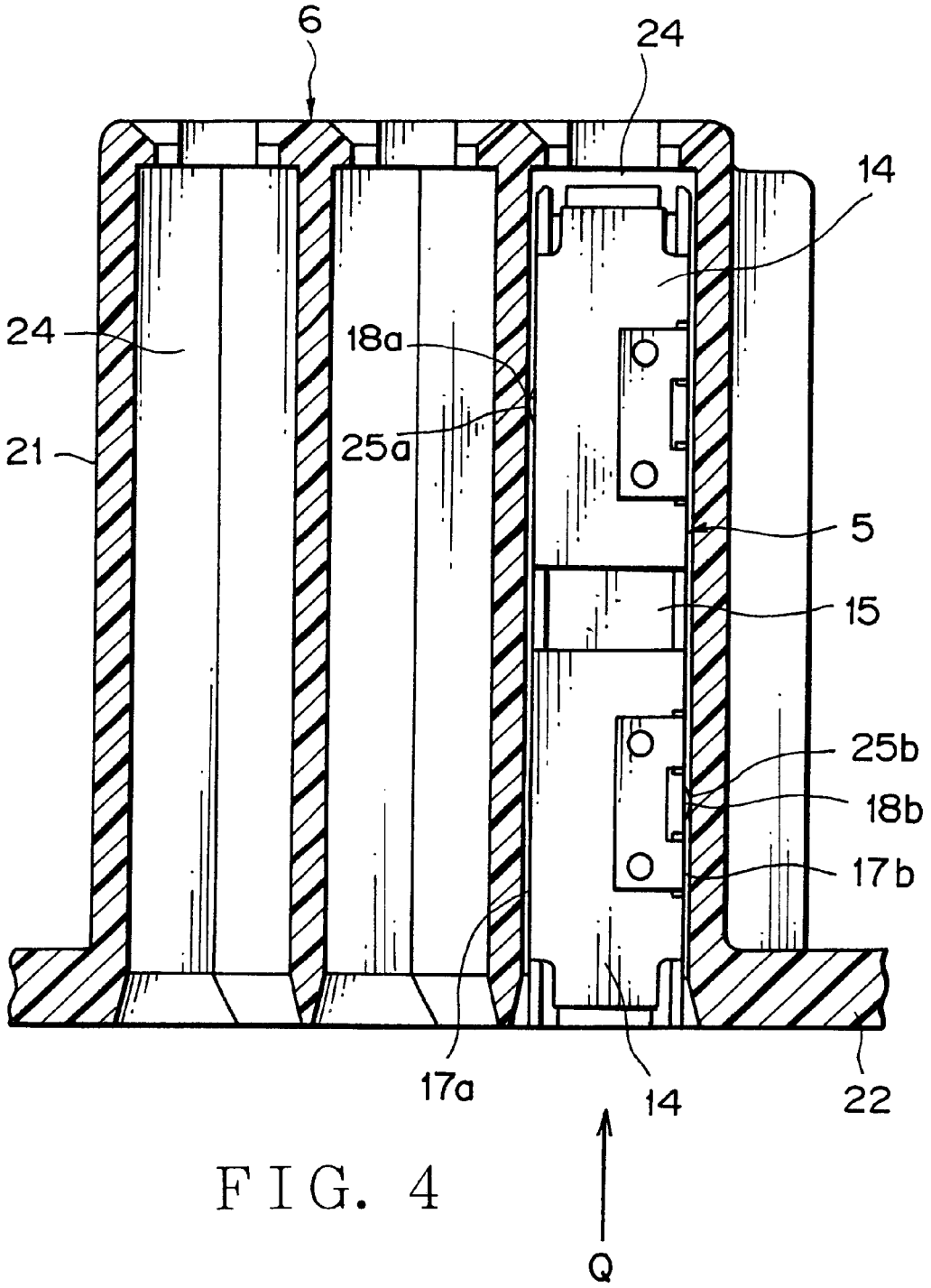
FIG. 4 is a sectional view taken along the line Z—Z of FIG. 2.

As shown in FIGS. 3 and 4, the relay terminal 5 is provided with a pair of projecting locking bosses 18*a*, 18*b* on its both side walls 17*a*, 17*b* extending parallel to a longitudinal direction (direction Q) of the relay terminal 5 or insertion direction of the relay terminal 5 into the housing member 6. One of the locking bosses 18*a* is disposed on the left side wall 17*a* toward one end (front end) of the relay terminal 5, while the other locking boss 18*b* is disposed on the right side wall 17*b* toward the other end (rear end). The locking boss 18*a* (18*b*) has a round shape projecting outwardly from the left side wall 17*a* (right side wall 17*b*) and slides, when the relay terminal 5 is inserted into the receiving cavity 24 of the housing member 6, in point contact on an inner surface of the receiving cavity 24. The point contact reduces frictional resistance when inserting the relay terminal 5 into the receiving cavity 24.

Figure 5A:
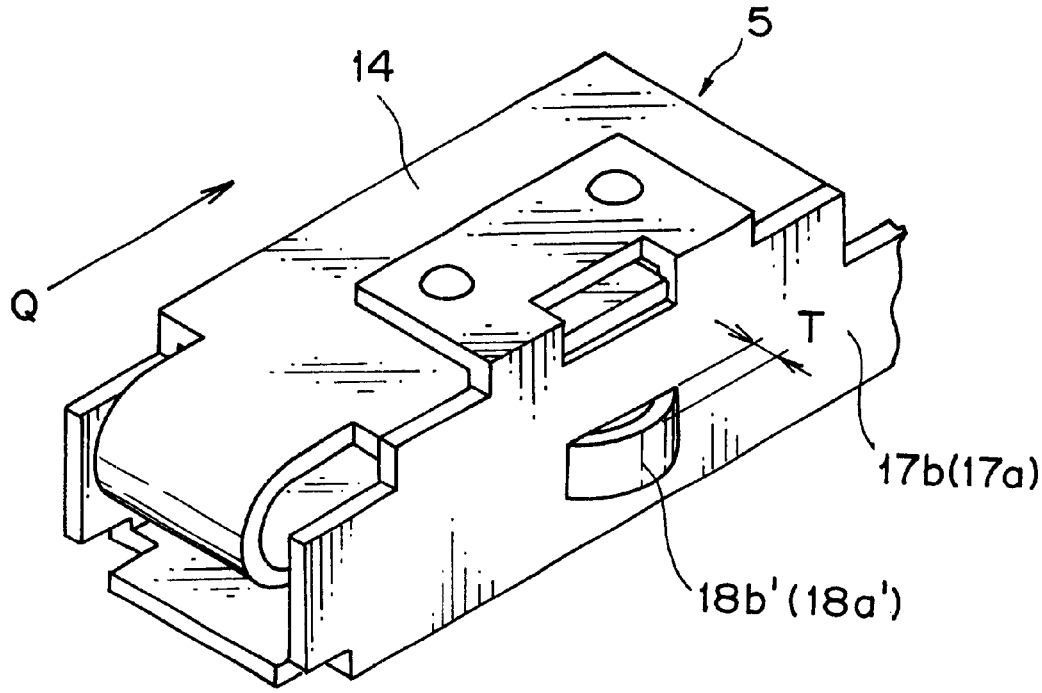
FIGS. 5A and 5B are enlarged perspective views showing variant examples of a locking boss of FIG. 3.

As shown in FIG. 5A, a first variant locking boss 18*a*' (18*b*') extends in the longitudinal direction of the relay terminal 5 (direction Q) while generally curved outwardly. The locking boss 18*a*' (18*b*'), if stamped with the relay terminal 5, can be made resilient. In other words, the locking boss 18*a*' (18*b*') can be resiliently deformed in a direction perpendicular to the longitudinal direction of the relay terminal 5. Thus, the locking boss 18*a*' (18*b*'), when inserting the relay terminal 5, slides smoothly in line contact on an inner surface of the receiving cavity 24. In this instance, because of the resiliency of the locking boss 18*a*' (18*b*'), the relay terminal 5 can be inserted with a small pressing force.

Figure 5B:
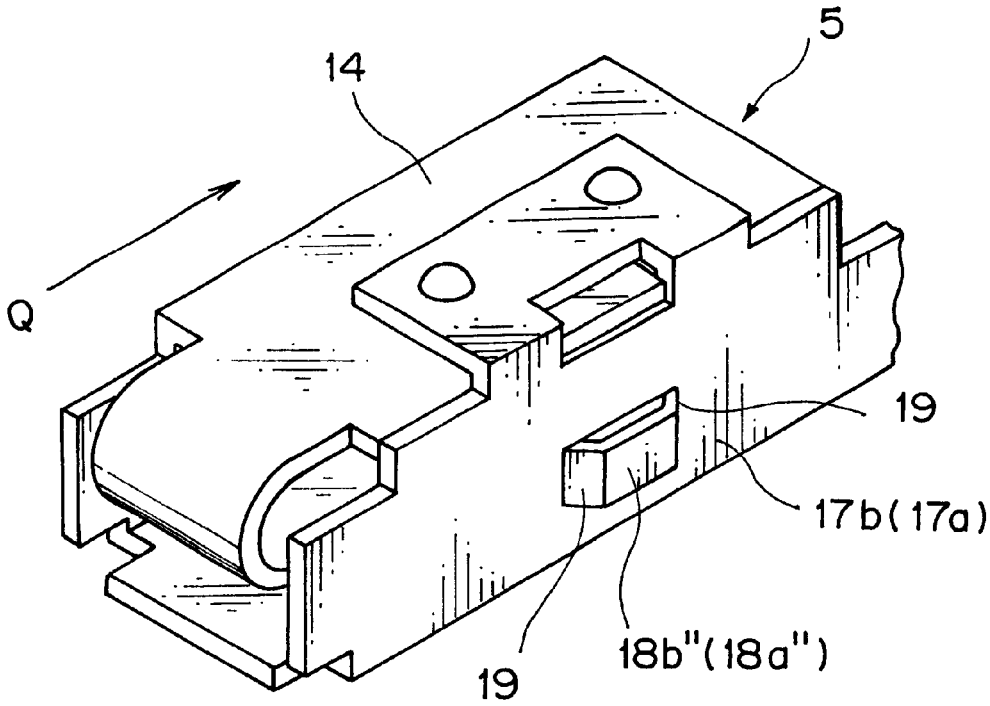

As shown in FIG. 5B, a second variant locking boss 18*a*" (18*b*") extends in the longitudinal direction (direction Q) while projected outwardly in a trapezoidal form with taper surfaces 19. In this instance, the locking bosses 18*a*" (18*b*") slides in surface contact on an inner surface of the receiving cavity 24, and the relay terminal 5 can be smoothly inserted with a small force as is the case with the first variant. As shown in FIGS. 3, 5A and 5B, the distance by which the locking boss 18*a* (18*b*) and the second variant locking boss 18*a*" (18*b*") project is the same as the projecting distance T of the first variant locking boss 18*a*' (18*b*'), and the projecting distance T is set such that the locking boss does not hinder the insertion of the relay terminal 5 into the housing member As shown in FIGS. 1 and 3, the housing member 6 is formed of insulating resin and comprised of a housing body 21 and a locking wall 22 integrally formed with the housing body to surround one end of the latter at a side where to insert the relay terminals 5. At a circumferential edge of the locking wall 22 is formed a locking flange 23 which projects on the housing body 21 side. As shown in FIG. 4, the housing body 21 is formed with a plurality of receiving cavities 24 for receiving the relay terminals 5 (and the tab-like terminals 4), each of which is provided on its inner surfaces with a pair of boss holes 25*a*, 25*b* for engagement therein of the locking bosses 18*a*, 18*b*.

As shown in FIG. 1, the upper cover 7 and the lower cover 8 are formed of insulating resin to have a box-like shape. The upper cover 7 is internally formed with a claw-like locking wall 27. By engagement of the locking wall 27 with the locking flange 23, the housing member 6 is fixed in the upper cover 7, in pressed condition toward the lower cover 8. The upper cover 7 and the lower cover 8 are provided with a locking means (not shown) that locks them together. While in the present embodiment the upper cover 7 and the housing member 6 are shown to be separate from each other, it is also possible to provide them in a one-piece design.

A method of assembling the electrical junction box 1 will now be described.

Figure 6:
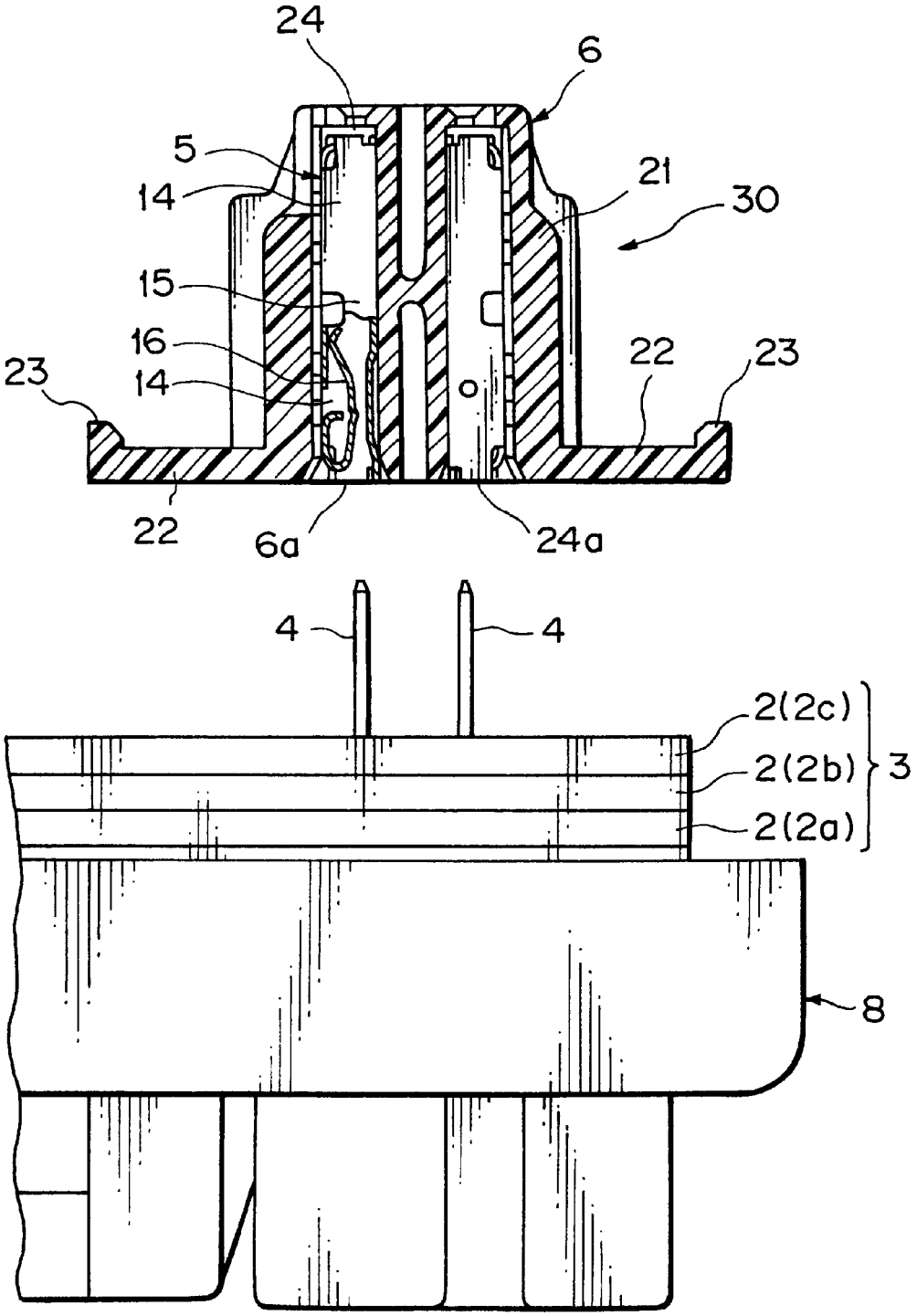
FIG. 6 is a partially sectional view of the electrical junction box of FIG. 1 under assembly.
Figure 7:
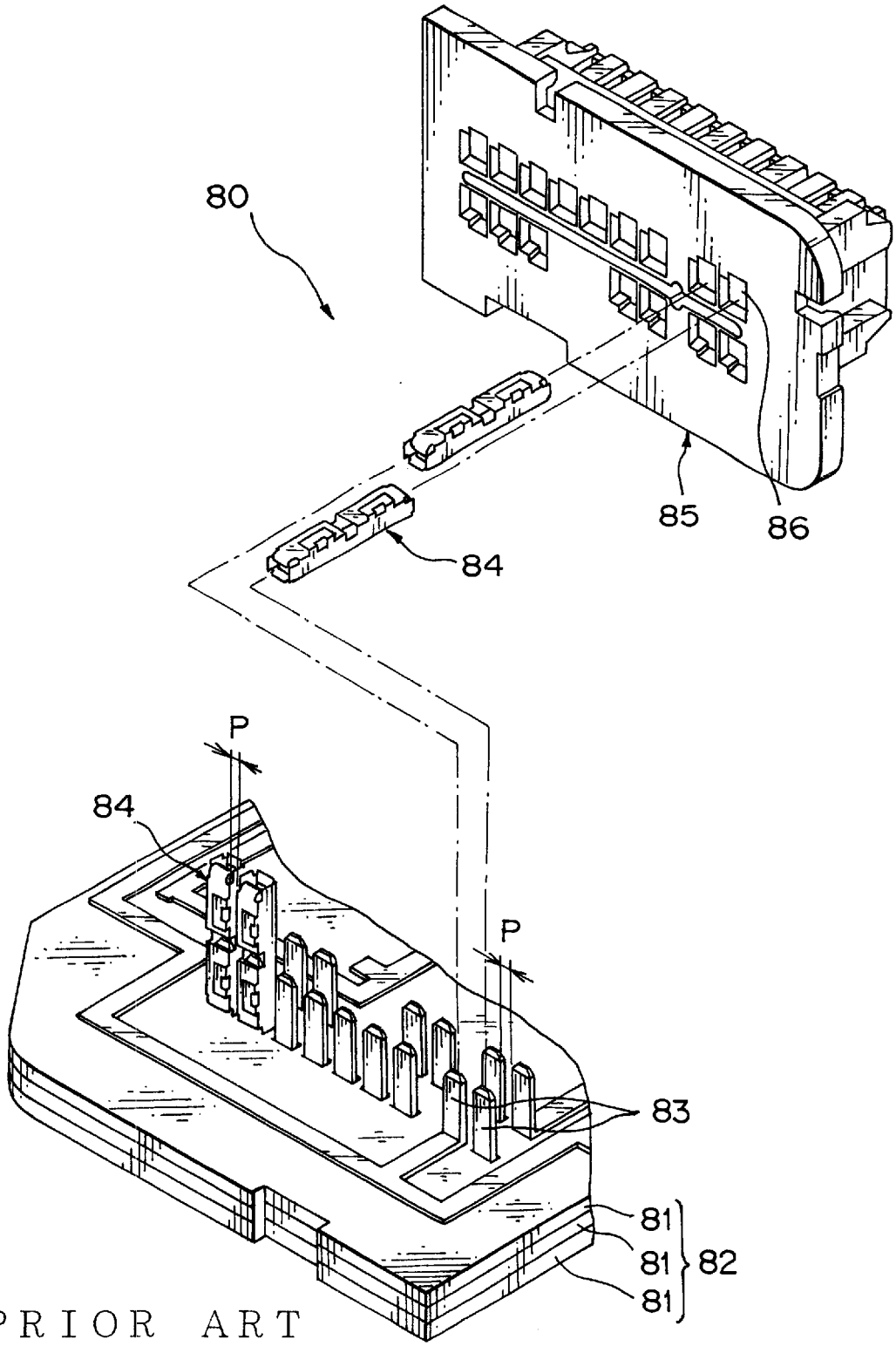
PRIOR ART FIG. 7
FIG. 7 is a perspective view of a conventional electrical junction box.
Figure 8:
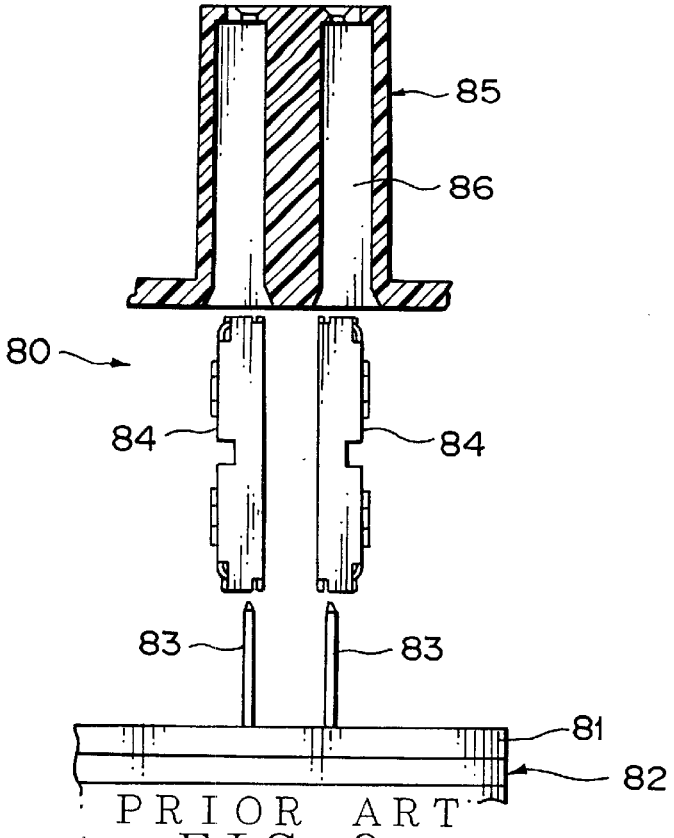
PRIOR ART FIG. 8
FIG. 8 is an explanatory view of the conventional junction box under assembly.
Figure 9:
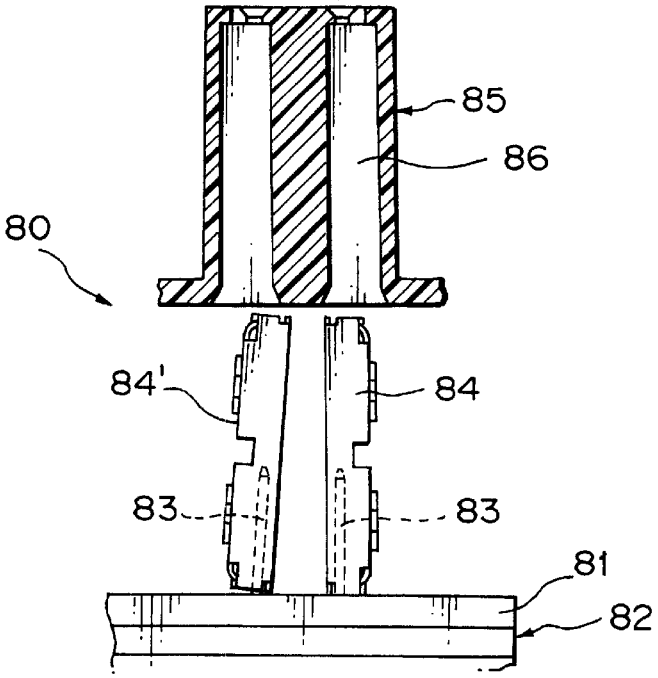
PRIOR ART FIG. 9
FIG. 9 is an explanatory view of a relay terminal tilted during the assembly of FIG. 8.

As shown in FIG. 6, the circuit body 3 is disposed inside the lower cover 8. The relay terminals 5 are pushed into the receiving cavities 24 of the housing member 6 so that the locking bosses 18*a*, 18*b* of the relay terminals 5 lockingly engage in the boss holes 25*a*, 25*b* of the receiving cavities 24. With the locking bosses 18*a*, and 18*b* located on the left side and right side walls 17*a* and 17*b*, respectively, the former toward one end and the latter toward the other end of the relay terminal 5, the relay terminal 5 is stable inside the receiving cavity 24, it not tending to tilt and standing upright in parallel with the relay terminal insertion direction. By locking the relay terminals 5 in the housing member 6, a sub connector 30 is formed (FIG. 3).

As shown in FIG. 6, the sub connector 30 is moved, with a rear surface 22*a* of the locking wall 22 first, toward the uppermost busbar circuit board 2*c*. The tab-like terminals 4 of the circuit body 3 are introduced through openings 24*a* into the receiving cavities 24 and pushed into the electrical contact portions 14 of the relay terminals 5 until the rear surface 6*a* of the housing member 6 abuts against the uppermost busbar circuit board 2*c* (FIG. 1). The sub connector 30 and the circuit body 3 are placed in position relative to each other by means of any positioning means.

As shown in FIGS. 1 and 6, because the relay terminals 5 inside the sub connector 30 are locked by the locking bosses 18*a*, 18*b* and the boss holes 25*a*, 25*b*, the relay terminals 5 do not move and are kept stationary inside the receiving cavities 24 during the -assembly of the sub connector 30 to the circuit body 3. The positional accuracy of the relay terminals 5 can thus be improved, leading to an easy and secure insertion of the tab-like terminals 4 into the relay terminals 5. High skill and experience are thus not required to connect the relay terminals 5 and the tab-like terminals 4 and the connecting operation can be done with efficiency.

Further, because the relay terminals 5 are locked inside the receiving cavities 24 during the connecting operation, the rear surface 6a of the housing member 6 does not interfere with the relay terminals 5, and deformation of relay terminals 5 and damages thereto can be prevented. Consequently, the tab-like terminals 4 are also protected from deformation and damages.

With the construction as mentioned above, where for example assembling the sub connector and the circuit body and connecting the relay terminals and their mating terminals are automated, an assembling failure and connecting failure are prevented at the same time on an automated assembly line.

Having now fully described the invention, it will be apparent to one of ordinary skill in the art that many changes and modifications can be made thereto without departing from the spirit and scope of the invention as set forth herein.

What is claimed is:

1. An electrical junction box comprising:

a relay terminal;

a housing member having a receiving cavity formed therein for receiving said relay terminal;

a circuit body having a mating terminal which mates with said relay terminal; and a locking means provided on said relay terminal for locking said relay terminal in said receiving cavity of said housing member, wherein said locking means comprises a pair of resilient locking bosses of round shape which project on both side walls of said relay terminal extending parallel to an insertion direction of said relay terminal into said receiving cavity for contact with an inner surface of said receiving cavity.

2. The electrical junction box according to claim 1, wherein said locking bosses are located at spaced positions in a longitudinal direction of said relay terminal.

3. An electrical junction box comprising:

a relay terminal;

a housing member having a receiving cavity formed therein for receiving said relay terminal;

a circuit body having a mating terminal which mates with said relay terminal; and a locking means provided on said relay terminal for locking said relay terminal in said receiving cavity of said housing member, wherein said locking means comprises a pair of resilient locking bosses extending in a longitudinal direction on both side walls of said relay terminal while curved outwardly for contact with an inner surface of said receiving cavity.

4. An electrical junction box comprising:

a relay terminal;

a housing member having a receiving cavity formed therein for receiving said relay terminal;

a circuit body having a mating terminal which mates with said relay terminal; and a locking means provided on said relay terminal for locking said relay terminal in said receiving cavity of said housing member, wherein said locking means comprises a pair of locking bosses extending in a longitudinal direction on both side walls of said relay terminal while projected outwardly in trapezoidal form, and tapered surfaces of said trapezoidal form rise in the longitudinal direction to meet another surface of said trapezoidal form, said another surface being a surface for contact with an inner surface of said receiving cavity for smooth insertion of said relay terminal.

5. A method of assembling an electrical junction box having a relay terminal, a housing member with a receiving cavity formed therein for receiving said relay terminal, a circuit body having a mating terminal which mates with said relay terminal, and a locking means provided on said relay terminal for locking said relay terminal in said receiving cavity, comprising:

locking said relay terminal in said receiving cavity of said housing member by means of said locking means to prepare a sub connector; and assembling said sub connector to said circuit body to electrically connect said mating terminal of said circuit body to said relay terminal inside said sub connector, wherein said locking means is selected from one of:

locking means comprising a pair of resilient locking bosses of round shape which project on both side walls of said relay terminal extending parallel to an insertion direction of said relay terminal into said receiving cavity for contacting an inner surface thereof, locking means comprising a pair of resilient locking bosses extending in a longitudinal direction on both side walls of said relay terminal while curved outwardly for contacting an inner surface of said receiving cavity, and locking means comprising a pair of locking bosses extending in a longitudinal direction on both side walls of said relay terminal while projected outwardly in trapezoidal form, with tapered surfaces of said trapezoidal form rising in a longitudinal direction to meet another surface of said trapezoidal form, said another surface being a surface for contact with an inner surface of said receiving cavity for smooth insertion of said relay terminal.

* * * * *